US008060962B2

(12) United States Patent
Shortt

(10) Patent No.: US 8,060,962 B2
(45) Date of Patent: Nov. 22, 2011

(54) TAPING KNIFE WITH HAMMER

(76) Inventor: David Shortt, Christmas, FL (US)

( * ) Notice: Subject to any disclaimer, the term of this patent is extended or adjusted under 35 U.S.C. 154(b) by 13 days.

(21) Appl. No.: 12/554,907

(22) Filed: Sep. 5, 2009

(65) Prior Publication Data

US 2011/0056027 A1 Mar. 10, 2011

(51) Int. Cl.
*B25D 1/00* (2006.01)
*B44D 3/16* (2006.01)

(52) U.S. Cl. ..... 7/143

(58) Field of Classification Search ..... 7/143, 144, 7/105, 165; 30/169
See application file for complete search history.

(56) References Cited

U.S. PATENT DOCUMENTS 860,593 A * 7/1907 Christensen ..... 7/143
4,620,369 A 11/1986 Gercken
5,850,663 A * 12/1998 Hardy et al. ..... 30/169
5,894,624 A * 4/1999 Fulenwider ..... 7/143
6,530,098 B1 3/2003 Gringer et al.
6,662,521 B1 12/2003 Escobedo et al.
6,742,215 B2 * 6/2004 Panfili et al. ..... 30/169
7,434,318 B2 10/2008 Perez et al.
7,458,127 B2 12/2008 Bruno et al.
2007/0074401 A1 4/2007 Myers et al.
2008/0047074 A1 2/2008 Rosso et al.

FOREIGN PATENT DOCUMENTS

WO 2007/018704 A1 2/2007

* cited by examiner

*Primary Examiner* — Hadi Shakeri
(74) *Attorney, Agent, or Firm* — Mesmer & Deleault, PLLC

(57) ABSTRACT

A taping tool apparatus having an elongated hammer portion that has a central axis and a striker portion, the striker portion having a striking plane perpendicular to the hammer portion central axis; a blade affixed to the hammer portion so that no part of the blade crosses the striker portion striking plane; and a handle affixed to the elongated hammer portion perpendicular to the central axis, whereby a user applying mud to fill indents in drywall with the taping tool can rotate the apparatus a quarter turn to hammer down any raised nails encountered without the blade striking the drywall.

12 Claims, 3 Drawing Sheets

TAPING KNIFE WITH HAMMER

BACKGROUND

1. Field of the Invention

The invention generally relates to hand tools used in building construction.

2. Description of the Related Art

In drywall installation used in building construction, the drywall must be nailed to its supporting structure to secure the drywall in place. Nails are driven with a hammer deeper than flush with the surrounding surface thereby producing nail indents in the drywall. Then a joint compound, often called "mud," is spread over the nail indents with a taping knife to cover them. Using the taping knife to wipe the wet mud across the nail indents also makes the now covered nail indents flat with the surround surface of the drywall. The procedure requires two different tools—a hammer and a taping knife.

When working on a section of drywall, the installer generally must use the two tools in sequence and have them ready at each work site. The work is manual labor intensive and does not lend itself to automation. It is especially strenuous work because the installer must perform many movements with his or her arms extended.

One can use industrial engineering techniques to measure the work involved by separating the different tasks. In the prior art the tasks are:

1. Locate hammer.
2. Lift hammer to nail location.
3. Pound in nail with hammer.
4. Put down hammer.
5. Locate taping knife.
6. Lift taping knife to nail location.
7. Apply mud with taping knife.
8. Put down taping knife.

Others have tried to better this process. Two examples are disclosed in U.S. Pat. No. 4,620,369 by Gerken and U.S. Pat. Pub. No. 2008/0047074 A1 by Rosso et al. These references disclose a taping knife with an integral hammer. In both references, the striking surface is at the end of the handle opposite the blade. They improve the prior art by reducing the amount of work involved. The analysis is as follows:

1. Locate knife/hammer.
2. Lift knife/hammer to nail location.
3. Pound in nail with hammer.
4. Turn knife/hammer around using both hands.
5. Apply mud with knife.
6. Put down taping knife/hammer.

Although there are fewer work tasks, these references have some disadvantages. First, the hammer must be swung like a club at the nail using the lightest end of the tool. This is inefficient and uncomfortable. Another way to use them is to jab the nail with the butt end of the handle like a dagger. The user's hand surrounds the handle. Therefore, if the user misses the nail, the nail will injure the user's hand. In both references, the user must rotate the tool end over end to use the opposite side. Using both hands can be dangerous if one is working on a ladder or scaffold, and requires coordinated work with both hands instead of one.

What is needed, therefore, is a taping knife with a hammer that positions the hammer striking portion perpendicular to the handle and aligned with the heaviest part of the tool.

SUMMARY

The invention is a taping knife with a hammer that satisfies the need for positioning the hammer striking portion perpendicular to the handle and aligning it with the heaviest part of the tool. The taping tool apparatus comprises an elongated hammer portion having a central axis and comprising a striker portion, the striker portion having a striking plane perpendicular to the hammer portion central axis; a blade affixed to the hammer portion so that no part of the blade crosses the striker portion striking plane; and a handle affixed to the elongated hammer portion perpendicular to the central axis, whereby a user applying mud to fill indents in drywall with the taping tool can rotate the apparatus a quarter turn to hammer down any raised nails encountered without the blade striking the drywall. These and other features, aspects, and advantages of the present invention will become better understood with regard to the following description, claims, and accompanying drawings.

DRAWINGS

DESCRIPTION

The invention is a taping tool with hammer apparatus comprises an elongated hammer portion having a central axis and comprising a striker portion, the striker portion having a striking plane perpendicular to the hammer portion central axis; a blade affixed to the hammer portion so that no part of the blade crosses the striker portion striking plane; and a handle affixed to the elongated hammer portion perpendicular to the central axis, whereby a user applying mud to fill indents in drywall with the taping tool can rotate the apparatus a quarter turn to hammer down any raised nails encountered without the blade striking the drywall.

Figure 1:
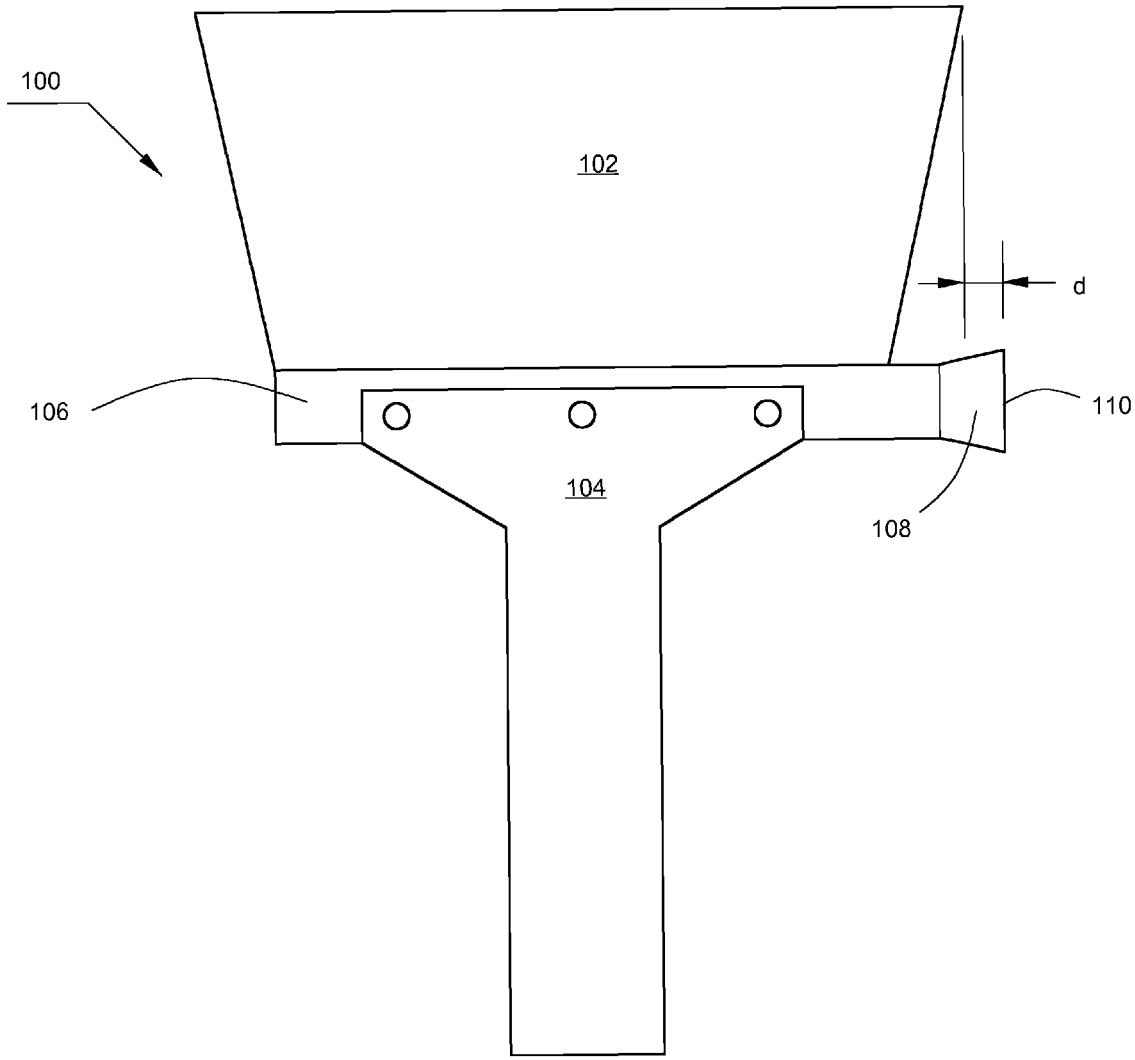
FIG. 1 is a front elevation of a taping tool with hammer apparatus according to the present invention.
Figure 2:
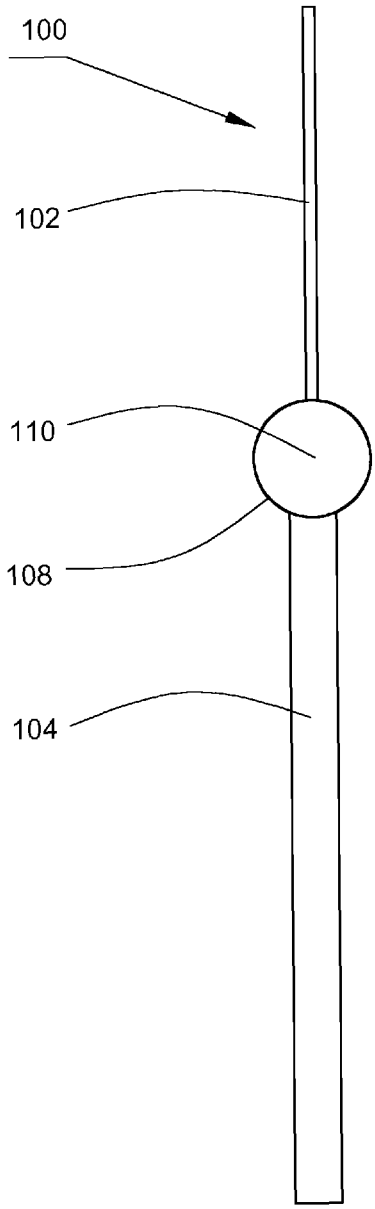
FIG. 2 is a right side elevation of the apparatus of FIG. 1.
Figure 3:
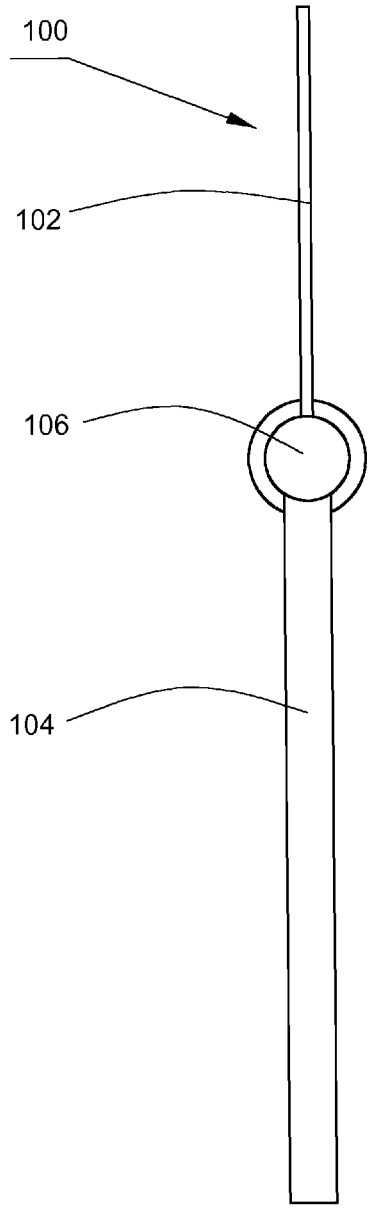
FIG. 3 is a left side elevation of the apparatus of FIG. 1.

FIGS. 1, 2 and 3 will be discussed at the same time. The taping tool with hammer apparatus 100 has an elongated hammer portion 106. Whether or not the hammer portion 106 is cylindrical, polygonal, or otherwise, it has a central axis. The hammer portion also has a striker portion 108 at one end. The striker portion 108 has a striking plane 110 that in this embodiment is perpendicular to the hammer portion central axis. The striker portion is preferably made of hardened steel, although other materials suitable for hammers could be used. The cross sectional area of the striker portion striking plane 110 may be greater than the cross sectional area of the remainder of the hammer portion 106. The striking plane is preferably flat and round and has a diameter of 1 inch. However, it is understood that the striker plane is not limited to this configuration.

The blade 102 is affixed aligned with the longitudinal axis of the hammer portion 106 so that no part of the blade 102 crosses the striker portion 108 striking plane 110. The striking plane 110 extends beyond the blade 102 by a distance "d" shown in FIG. 1. This extension ensures that the blade will not strike and damage the drywall when the apparatus is being used as a hammer. It has been found that distance "d" of at least ⅜ inch works well.

In a preferred embodiment, the blade 102 forms approximately a trapezoid having a short base and a long base. The blade 102 is affixed to the hammer portion 106 by the trapezoid short base. The trapezoid long base has been found to work well when its width is about 7.5 inches. The non-base sides need not be straight.

Figure 4:
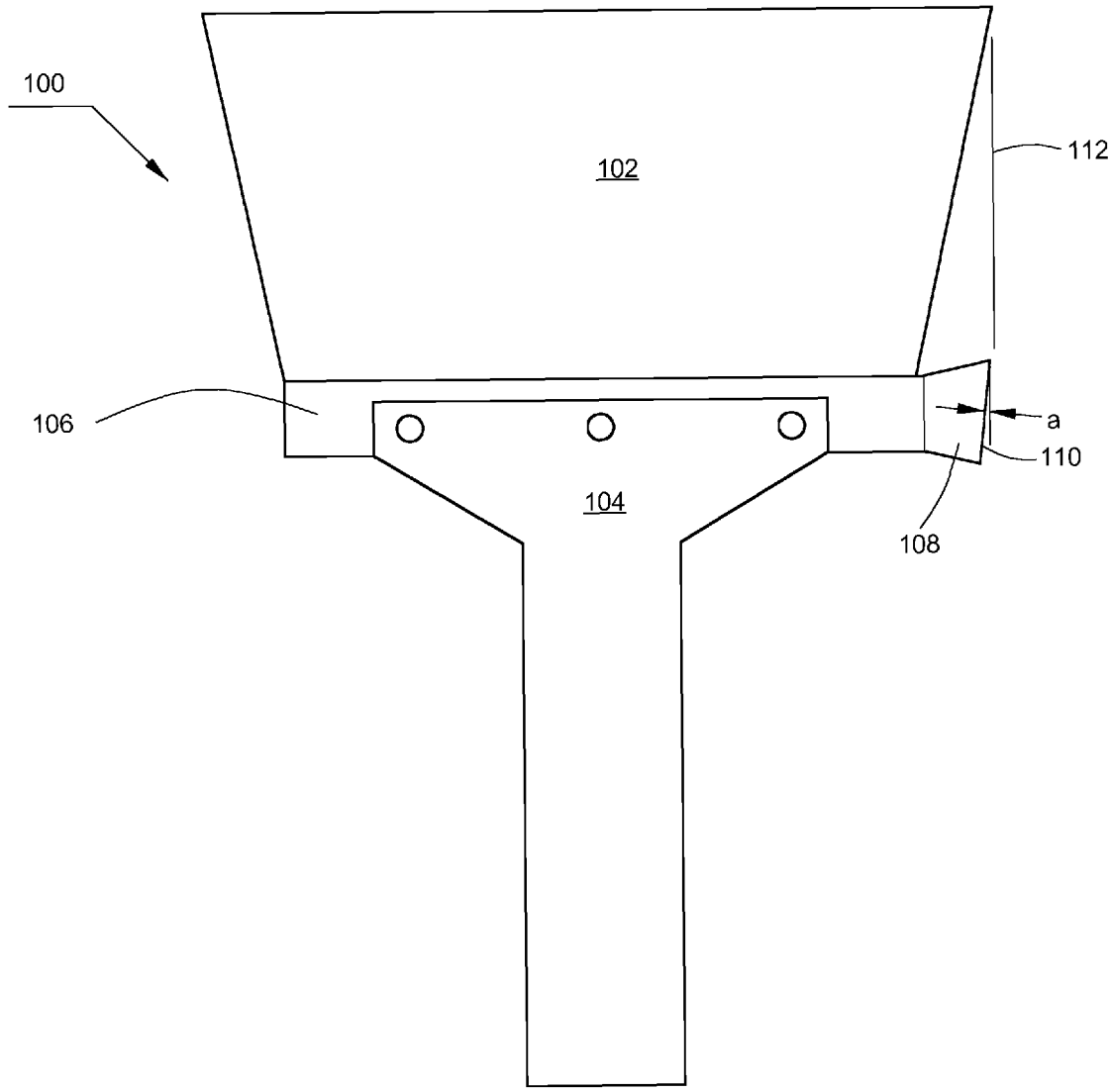
FIG. 4 is a front elevation of another embodiment of the present invention.

FIG. 4 is a front elevation of another embodiment of the present invention. In this embodiment, the striker plane 110 is behind the edge 112 of the blade 102, but is tapered toward the handle 104. A satisfactory taper has been shown to be about 5 degrees. In this embodiment, the striking surface 110 can strike the nail squarely without extending beyond the edge 112 of the blade 102.

In operation, the physical work involved in performing the same tasks is less. The steps are as follows:

1. Locate knife/hammer.
2. Lift knife/hammer to nail location.
3. Pound in nail with hammer.
4. Rotate knife/hammer one-quarter turn.
5. Apply mud with knife.
6. Put down taping knife/hammer.

Step 4 takes much less work and is much safer than what is done in the prior art. Turning the tool a quarter turn takes much less work than rotating the tool end over end with both hands. It is also much safer because the user does not have to let go of a ladder or scaffold and the user is not in danger of injuring his or her hand if he or she misses the nail. The present invention is also more efficient because the user uses the heaviest part of the tool as the hammer. The center of percussion of the tool is also roughly centered on the striking plane, making it perfectly comfortable to use.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A taping tool with hammer apparatus comprising:

an elongated hammer portion having a central axis and comprising a striker portion, the striker portion having a striking plane perpendicular to the hammer portion central axis;

a blade affixed to the hammer portion so that no part of the blade crosses the striker portion striking plane; and a handle affixed to the elongated hammer portion perpendicular to the central axis, whereby a user applying mud to fill indents in drywall with the taping tool can rotate the apparatus a quarter turn to hammer down any raised nails encountered without the blade striking the drywall;

wherein the cross sectional area of striker portion striking plane is greater than the cross sectional area of the remainder of the hammer portion.

2. The apparatus of claim 1, wherein the striking plane clears the blade by at least ⅜ inch.

3. The apparatus of claim 1, wherein the blade has a width of 7.5 inches.

4. The apparatus of claim 1 claim 1, wherein the striker portion is round and has a diameter of 1 inch.

5. The apparatus of claim 1, wherein the striking plane is made of hardened steel.

6. The apparatus of claim 1, wherein the blade forms a trapezoid and is affixed to the hammer portion at the trapezoid short base.

7. A taping tool with hammer apparatus comprising:

an elongated hammer portion having a central axis and comprising a striker portion, the striker portion having a striking plane tapered toward the a handle with respect to the central axis;

a blade affixed to the hammer portion so that no part of the hammer portion crosses the edge of the blade; and a handle affixed to the elongated hammer portion perpendicular to the central axis, whereby a user applying mud to fill indents in drywall with the taping tool can rotate the apparatus a quarter turn to hammer down any raised nails encountered without the blade striking the drywall;

wherein the cross sectional area of striker portion striking plane is greater than the cross sectional area of the remainder of the hammer portion.

8. The apparatus of claim 7, wherein the axis of the striker portion is tapered toward the handle with respect to the central axis by about 5 degrees.

9. The apparatus of claim 7, wherein the blade has a width of 7.5 inches.

10. The apparatus of claim 7, wherein the striker portion is round and has a diameter of 1 inch.

11. The apparatus of claim 7, wherein the striking plane is made of hardened steel.

12. The apparatus of claim 7, wherein the blade forms a trapezoid and is affixed to the hammer portion at the trapezoid short base.

* * * * *